US005482393A

United States Patent [19]

Sekiguchi et al.

[11] Patent Number: 5,482,393

[45] Date of Patent: Jan. 9, 1996

[54] CORRECTOR

[75] Inventors: Kazuhiko Sekiguchi; Yoshihiko Chikugo, both of Tokyo, Japan

[73] Assignee: Zebra Co., Ltd., Tokyo, Japan

[21] Appl. No.: 292,295

[22] Filed: Aug. 16, 1994

Related U.S. Application Data

[63] Continuation of Ser. No. 33,029, Mar. 18, 1993, abandoned.

[30] Foreign Application Priority Data

Apr. 2, 1992 [JP] Japan ..... 4-019746 U
Sep. 18, 1992 [JP] Japan ..... 4-249739

[51] Int. Cl.[6] ..... B43K 7/00

[52] U.S. Cl. ..... 401/214; 401/260

[58] Field of Search ..... 401/214, 260, 401/103

[56] References Cited

U.S. PATENT DOCUMENTS

| | | | |
|---|---|---|---|
| 720,705 | 2/1903 | Burt | 401/214 |
| 1,563,408 | 12/1925 | Sutherland | 401/214 |
| 3,232,278 | 2/1966 | Johmann | 401/103 |
| 3,379,490 | 4/1968 | Schwartzman | 401/214 |
| 4,511,273 | 4/1985 | Trotta | 401/260 |
| 4,685,820 | 8/1987 | Kremer et al. . | |
| 5,056,949 | 10/1991 | Petrillo | 401/214 |

FOREIGN PATENT DOCUMENTS

| | | | |
|---|---|---|---|
| 461361 | 12/1913 | France | 401/214 |
| 964045 | 7/1950 | France | 401/214 |
| 1002939 | 3/1952 | France | 401/214 |
| 2452386 | 3/1979 | France . | |
| 2662642 | 5/1990 | France . | |
| 529451 | 7/1931 | Germany | 401/214 |
| 3616116A1 | 11/1987 | Germany . | |

OTHER PUBLICATIONS

Ratioplast GmbH Kunststoffverarbeitung, Derwent Publications Ltd., London, GB; Section PQ, Week 8849, Dec. 8, 1988 (Abstract only).

*Primary Examiner*—Steven A. Bratlie
*Attorney, Agent, or Firm*—Klauber & Jackson

[57] ABSTRACT

A dispenser for applying correction liquid to writing errors. The dispenser includes a valving rotary ball which controls the dispensing, with the rotary ball being normally biased against a spring member via an elongated biasing element, to shut off dispensing of the correction liquid. To insure integrity of shut-off and dispensing of correction liquid, the biasing member is a cylindrical member which has been integrally deformed at the end distant from the rotary ball to provide an outwardly extending stepped portion which firmly engages with the biasing spring.

6 Claims, 3 Drawing Sheets

CORRECTOR

This Application is a Continuation of application Ser. No. 08/033,029, filed Mar. 18, 1993 now abandoned.

FIELD OF THE INVENTION

The present invention relates to a corrector device for applying a correcting liquid on an error to permit writing a corrected character thereon.

DESCRIPTION OF THE RELATED ART

In general, liquid dispensing correctors are constructed as shown in FIG. 4. Specifically such correctors have a valve 12, biased by a coil spring 11 toward a liquid outlet 10 provided at the leading edge of the corrector. In operation, the leading edge of valve 12 which projects from the liquid outlet 10 to the outside is pushed onto an error portion on a paper, and concurrently is depressed within the liquid outlet 10 against the biasing force of the coil spring 11. Liquid outlet 10 is opened thereby, and a correcting liquid is applied onto the error portion.

In conventional correctors such as shown in FIG. 4, the correction operation is made by constantly exerting a downward pressure on a main body of corrector, thereby resulting in the following inconveniences. For example, when a full line of the document is to be corrected or a depicted drawing figure is to be corrected, the correcting operation is lengthy, with resultant wrist fatigue and possible paper gouging by the leading edge of the valve.

Also, in the conventional corrector, the coil spring 11, used for biasing the valve 12 in the direction of the liquid outlet 10, is engaged with the valve 12 via an engaging member 13, formed in a stepped ring shape which is fixedly inserted in the rear end portion of the valve 12. The end portion of the coil spring 11 is inserted and fitted to the stepped surface of the engaging member 13 by being abutted thereon. However, variations in the mounting state of the engaging member 13, with respect to the rear end portion of the valve 12, result in variations in the magnitude of the biasing force of the coil spring applied in the direction of closing the valve 12. For example, if the energizing force of the coil spring is weakened, by movement of engaging member 13 or original improper placement, the valve 12 is more freely moved, thereby freely opening the liquid outlet 10, which permits the leakage of the correcting liquid to the outside. Further, with the liquid outlet 10 being opened to the outside air for extended periods of time, the correcting liquid has a tendency to gradually become solidified, by the contact with the outside air, thereby blocking the liquid outlet 10. Movement of the valve 12 is also blocked by the solidified correcting liquid, which prevents use of the corrector.

Alternatively, if the biasing force of the coil spring is excessively strong, the pushing of the leading edge of the valve 12, onto an error, in order to open the liquid outlet 10 for applying the correcting liquid on the error, is slowed, with reduced flow of the correcting liquid, thereby making it impossible to smoothly apply the correcting liquid on an error.

In addition, in the conventional corrector, the valve 12 and the engaging member 13 are fabricated separately from each other, and the engaging member 13 is fixed to the rear end portion of the valve with resultant increased labor in fabrication and deterioration of the production of the corrector.

OBJECT AND SUMMARY OF THE INVENTION

Accordingly, an object of the invention is to provide a corrector which improves the application of a correcting liquid on an error portion.

Another object of the present invention is to provide a biasing member for the coil spring which stabilizes the quality of use and which reduces the number of parts in the assembling process.

Other objects of the present invention will be apparent from the detailed description of the preferred embodiments and the accompanying drawings.

In the corrector of the present invention, a rotary body is provided in a tip liquid outlet of a corrector main body for supplying a correcting liquid. The rotary body is suitably biased in the direction of the tip liquid outlet. The corrector includes a biasing lever or element which is axially movably provided within the corrector main body, with the rotary body being biased thereby in the direction of the liquid outlet, by a coil spring. One end side of the biasing lever is abutted on the rotary body, and the other end of the biasing lever is integrally provided with an engaging member for providing firm engagement with the coil spring.

BRIEF DESCRIPTION OF THE DRAWINGS

FIGS. 3A to 3C are views showing the usage of the corrector of the present invention, wherein FIG. 3A is a front view showing the usage state, FIG. 3B is an enlarged sectional view of the main part thereof, and FIG. 3C is a sectional view showing the state when a rotary body is rotated and a correcting liquid is supplied and applied by the rotation.

DETAILED DESCRIPTION OF THE PREFERRED EMBODIMENTS

Figure 1A:
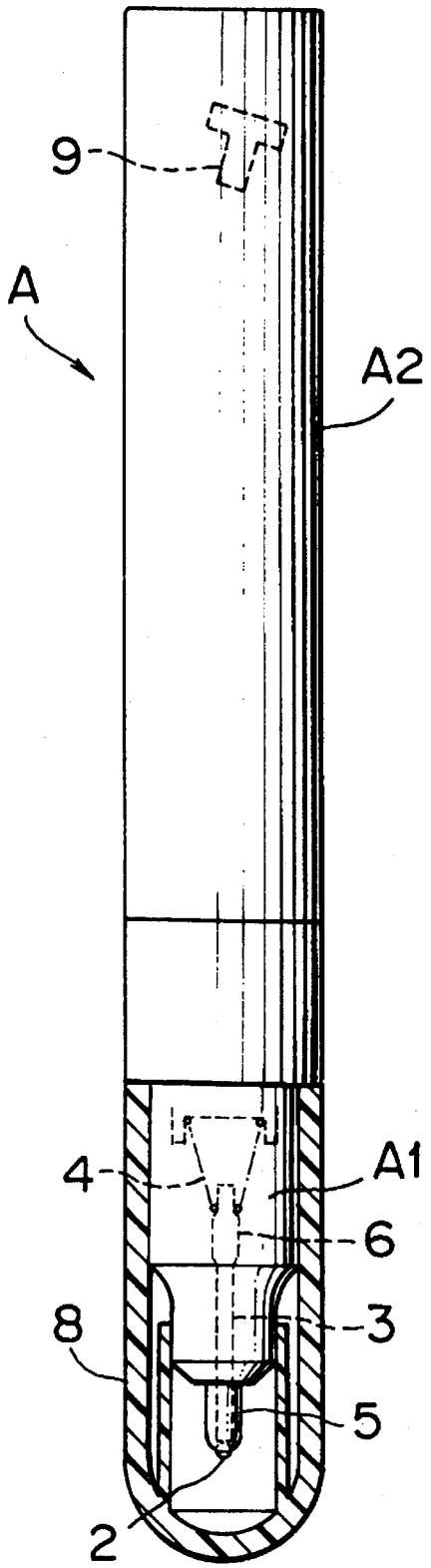
FIG. 1A is a partially sectioned view of the corrector of the present invention.

Hereinafter, one form of an embodiment according to the present invention will be described with reference to the accompanying drawings. The shape of a corrector main body A includes various types, such as a known vessel type, a pen type as shown in the figures, and the like. In the corrector main body A, a rotary body 2 is provided within a tip liquid outlet 1, provided at a tip cap A1, for supplying a correcting liquid. The rotary body 2 is biased in the direction of the liquid outlet 1, that is, in the closing direction by the biasing force of a coil spring 4, through biasing lever 3, for closing the liquid outlet 1 by the rotary body 2. A tube body 5 is formed at a suitable length to be drawn at the leading edge portion using a metal, hard resin or the like and is inserted and fitted in the leading edge of the tip cap A1. The liquid outlet 1 is provided in tube body 5 at the leading edge portion of the tip cap A1. The rotary body 2 is contained in the tube 5, and the biasing lever 3 is axially movably provided in the tube 5 in a position where one end thereof, abuts on the rotary body 2, and the other end thereof projects through the tip cap A1, and the lever moves freely within tube 5.

The rotary body 2 is intended to supply and apply a correcting liquid on a paper surface B by rotation (rolling) under the contact (friction) with the paper surface B. The rotary body 2 is formed in a spherical ball shape having a diameter slightly smaller than the inside diameter of the tube 5, using the desired material such as stainless steel, and which is provided within the tip liquid outlet 1 of the tube body 5 in such a manner as to be rotated by the contact with the paper surface B while being suitably biased by the coil spring 4 through the biasing lever 3.

The biasing lever 3 is intended to bias the rotary body 2 in the direction of closing the liquid outlet 1 by the suitable biasing force of the coil spring 4. The biasing lever 3 has a diameter small enough to provide a clearance for permitting the flow of the correcting liquid between the inner peripheral surface of the tube body 5 and the same, and which is formed to be so long that one end side thereof is abutted on the rotary body 2 contained within the liquid outlet 1 whereas the other end side thereof projects within the tip cap A1, whereby engaging portion 6 at lever 3 firmly engages with coil spring 4. Engaging portion 6 is integrally provided on the end of the biasing lever 3, distal to its abutment with rotary body 2.

Figure 2:
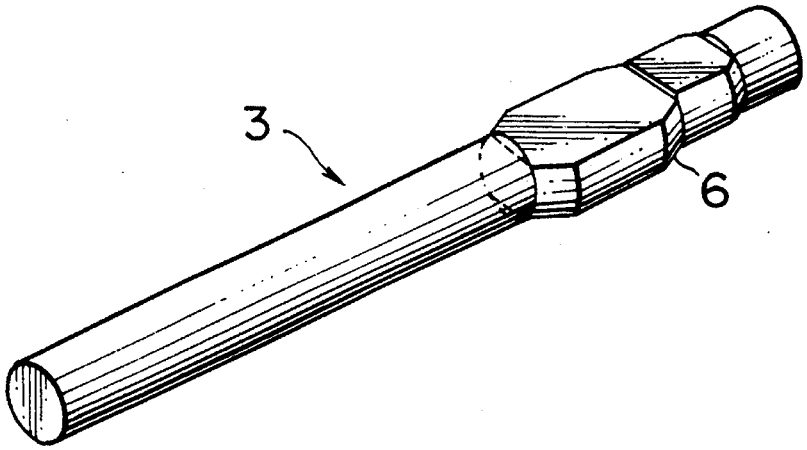
FIG. 2 is an enlarged perspective view of a biasing lever.
Figure 4:
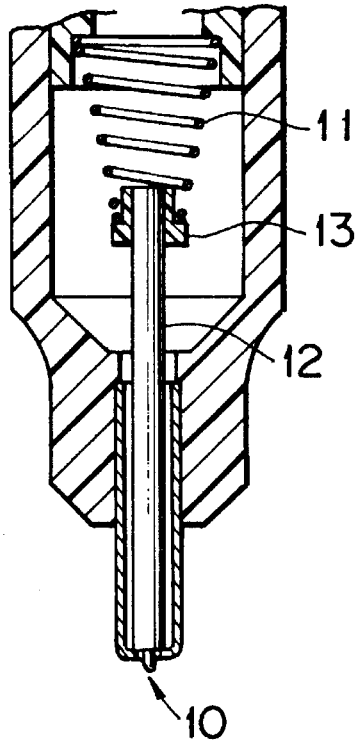
FIG. 4 PRIOR ART
FIG. 4 is a sectional view of a main part of a corrector according to prior art.

The engaging part 6 is intended to firmly engage with one end portion of the coil spring 4. As shown in FIG. 2, the upper portion of the biasing lever 3 is flattened in such a manner that stepped portions project from the aligned sides of lever 3, thereby integrally forming the engaging portion 6.

The coil spring 4 is formed in a head-cut conical shape, wherein the winding diameter (coil diameter) is substantially the same as that of the biasing lever 3 at one end portion thereof, and is gradually increased as it nears the other end portion thereof. One end portion of the coil spring 4 is firmly engaged with the engaging portion 6 of the biasing lever 3, projecting within the tip cap A1, whereas the other end portion side at spring 4 is elastically mounted within the tip cap A1 in the state of being abutted and engaged to an inner side stepped portion 7*a* of a ring-like packing 7, fitted within a tank connection opening for, connecting a liquid tank A2 of the tip cap A1.

According to the corrector of this embodiment, having the above construction, the coil spring 4 is engaged to the biasing lever 3 in such a manner that the end portion of the coil spring 4 is firmly engaged with the engaging portion 6. Since portion 6 is integrally provided at an end of lever 3 by flattening the biasing lever itself, it becomes possible to accurately specify the exact engaging position of the coil spring 4 relative to the biasing lever 3. Accordingly, it is also possible to specify the biasing force applied through the biasing lever 3, for biasing the rotary body 2 in the direction of the liquid outlet 1, that is, in the direction of closing the liquid outlet 1 (in the downward direction in the enlarged sectional view of FIG. 1), and hence to achieve the stability of the quality. This makes it possible to abut the rotary body 2 on the liquid outlet 1 by the stabilized biasing force with reduced chance of opening the liquid outlet 1, and hence to certainly close the liquid outlet 1. Further, this makes it possible to provide for rapidly moving the biasing lever 3 against the biasing force of the coil spring 4 in the open direction (in the upward direction in the enlarged sectional view of FIG. 3B). Correcting liquid is applied while contacting the rotary body with the error portion of the paper surface B for opening the liquid outlet 1, and to smoothly supply the correcting liquid from the liquid outlet 1 accompanied with the rotation of the rotary body 2 for applying the correcting liquid on the error portion of the paper surface B.

Figure 1B:
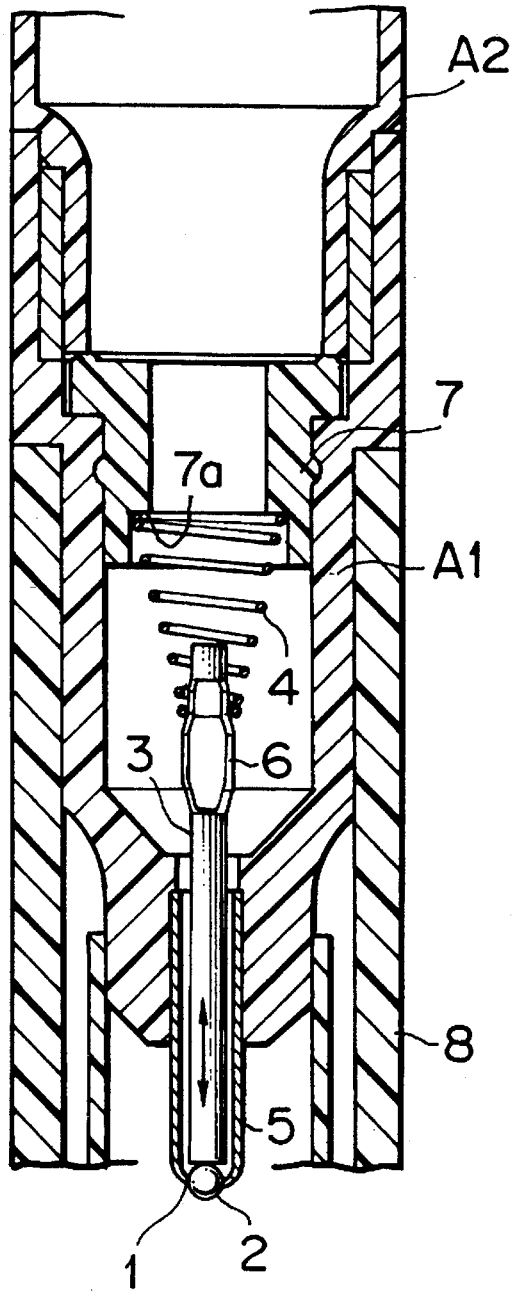
FIG. 1B is a partially enlarged front view showing one form of an embodiment of a corrector as shown in FIG. 1A.

In FIG. 1A, numeral 8 indicates a pen cap; and 9 is an agitating bar contained within the correcting liquid tank.

Figure 3A:
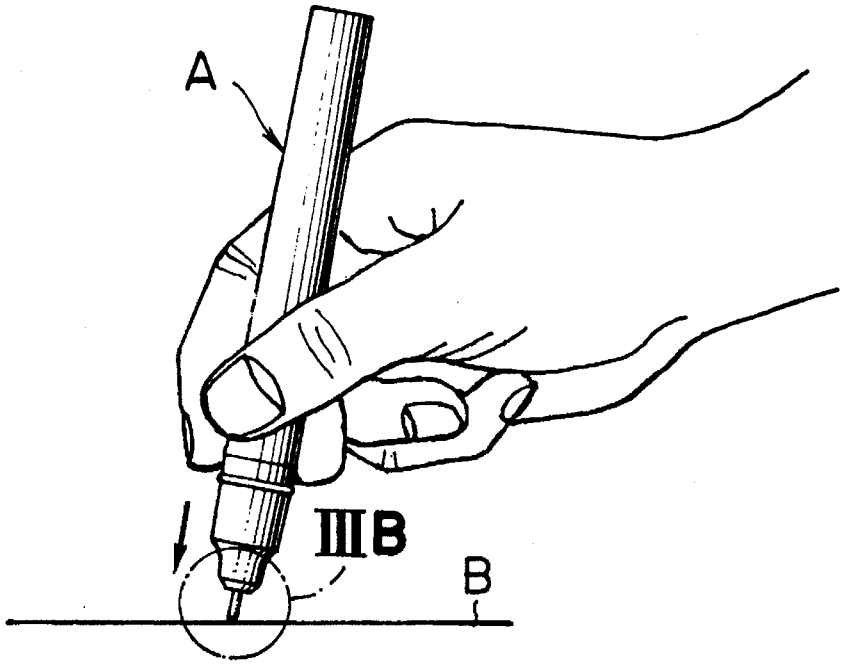
Figure 3B:
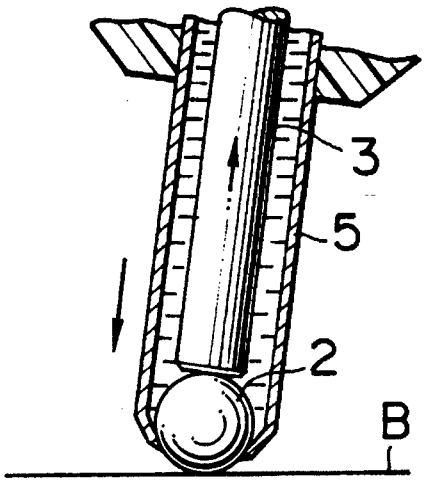
Figure 3C:
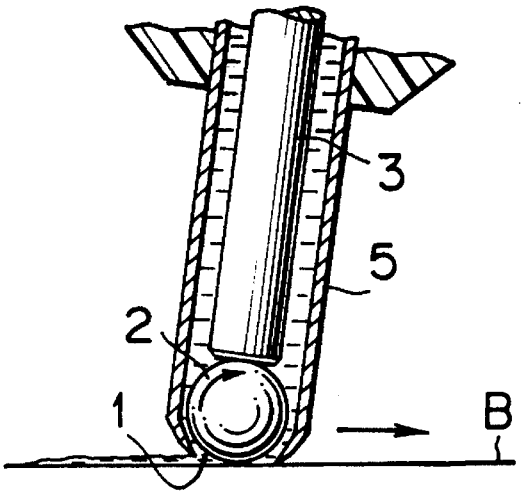

In operation, the pen cap 8 is removed, and the rotary body 2 is applied to the paper surface B corresponding to the error portion of the document (see FIG. 3A and 3B). Then, in such a state, the corrector main body A is moved, as in writing a character, with for example, a ball point pen, so that the rotary body 2 is rotated, and the correcting liquid is sequentially supplied on the error portion by the rotation of the rotary body 2 applied thereon (see FIG. 3C).

In the embodiment described above, the rotary body 2 is formed in a ball-like shape; however, the shape of the rotary body 2 is not limited thereto, and may include a roller-like shape. In the case of using the rotary body 2 having such form, the tube body 5 is substantially formed in a sheet-like cylindrical shape and is inserted in and fitted to the leading edge of the corrector main body A, thus forming the opening shape of the liquid outlet 1 in a longitudinal rectangular shape, and concurrently the energizing lever 3 is formed in a sheet-like shape. Thus, the rotary body is formed in a roller-like shape, the correcting liquid is supplied and applied with a width correspondence to the rotary body, that is, the roller by moving the corrector main body in a manner just as writing a line.

As described above, in the corrector of the present invention, as the corrector main body is moved in the state that the rotary body provided on the tip liquid outlet is touched on the error portion, the rotary body is rotated, and the correcting liquid is supplied on the error portion by the rotation thereof, to be applied thereon.

Accordingly, it is possible to apply the correcting liquid along an error portion and a figure by the operation similar to writing a character and drawing a line, and therefore, the operation is extremely simplified as compared with the conventional manner. Also, since the correcting operation is improved, the load applied to a wrist can be reduced. Further, it is possible to apply the correcting liquid while rolling the corrector main body, and to provide a corrector optimal for correction along the edge of the character or the figure.

Further, since the end portion of the coil spring is firmly engaged with to the engaging portion integrally formed on the biasing lever, it is possible to determine the engaging state (engaging position) of the coil spring to the biasing lever, and hence to stabilize the biasing force for biasing the rotary body in the direction of the tip liquid outlet.

In the present invention, therefore, there can be provided a corrector with stabilized quality, without variation in the magnitude of the biasing force, as in conventional correctors. There is also a reduction in the number of parts and assembling processes with resultant improved productivity.

We claim:

1. An improved corrector for dispensing correction liquid on writing errors, said improved corrector comprising:

a main body having a tip liquid outlet through which a correction liquid may be dispensed;

a rotary body provided within said tip liquid outlet, said rotary body being sized and positioned within said tip liquid outlet so as to prevent a correction liquid from being dispensed from said tip liquid outlet when said rotary body is stationary within said tip liquid outlet, said rotary body also being sized and positioned within said tip liquid outlet so as to allow a correction liquid to be dispensed from said tip liquid outlet when said rotary body is rotated within said tip liquid outlet; and biasing means for biasing said rotary body toward said tip liquid outlet, said biasing means comprising:

an elongated biasing lever axially movable within said main body, said lever having a first end abutting said rotary body, said lever having a second end disposed within said main body inward from said liquid tip outlet; and a compressed spring member, said spring member firmly engaged with said second end of said lever so as to bias said rotary body toward said tip liquid outlet;

the improvement comprising said second end of said lever having an integral lateral extension which firmly engages with said spring member so as to accurately specify an exact engaging position of said spring member relative to said lever and thereby apply a specific biasing force to said rotary body.

2. The improved corrector as defined in claim 1, wherein said lever comprises a cylindrical member, and wherein a portion of said second end is flattened so as to form said integral lateral extension.

3. The improved corrector as defined in claim 2, wherein said integral lateral extension comprises aligned stepped portions extending outward from said cylindrical member.

4. The improved corrector as defined in claim 3, wherein said cylindrical member is flattened at a distance from said second end which allows said spring member to be fitted over said second end of said cylindrical member and into firm engagement with said aligned stepped portions.

5. The improved corrector as defined in claim 4, wherein said spring member is firmly engaged with said aligned stepped portions in both vertical and horizontal directions so as to accurately specify an exact engaging position of said spring member relative to said lever and thereby apply a specific biasing force to said rotary body.

6. The improved corrector as defined in claim 1, wherein said rotary body is formed in a spherical ball-like shape.

* * * * *